US012000081B2

(12) United States Patent
Ekbundit

(10) Patent No.: US 12,000,081 B2
(45) **Date of Patent: *Jun. 4, 2024**

(54) TRAVEL CYCLE FOR A CONDENSER OR HEAT PUMP DRYER APPLIANCE

(71) Applicant: Haier US Appliance Solutions, Inc., Wilmington, DE (US)

(72) Inventor: Michael Wuttikorn Ekbundit, Mount Washington, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 668 days.

This patent is subject to a terminal disclaimer.

(21) Appl. No.: 17/205,627

(22) Filed: Mar. 18, 2021

(65) Prior Publication Data

US 2022/0298718 A1 Sep. 22, 2022

(51) Int. Cl.
*D06F 58/34* (2020.01)
*D06F 34/04* (2020.01)
(Continued)

(52) U.S. Cl.
CPC ..... *D06F 58/34* (2020.02); *D06F 34/04* (2020.02); *D06F 34/18* (2020.02); *D06F 34/20* (2020.02);
(Continued)

(58) Field of Classification Search
CPC ..... D06F 58/34; D06F 58/24; D06F 34/20; D06F 34/04; D06F 34/18; D06F 34/28;
(Continued)

(56) References Cited

U.S. PATENT DOCUMENTS 4,693,016 A * 9/1987 Yamazaki ..... F26B 13/16 34/115
5,560,120 A * 10/1996 Swanson ..... D06F 58/22 55/320

(Continued)

FOREIGN PATENT DOCUMENTS

JP 2000051595 A 2/2000
WO WO2018099438 A1 6/2018

OTHER PUBLICATIONS

Equator super combo-automatic washer + sensor dryer 4400N, Equator Advanced Appliances.

*Primary Examiner* — Stephen M Gravini
(74) *Attorney, Agent, or Firm* — Dority & Manning, P.A.

(57) ABSTRACT

A dryer appliance and a method of operating the same are provided. In one aspect, the dryer appliance includes a drum rotatably mounted within a cabinet. The drum defines a chamber that is in fluid communication with a conditioning system of the dryer appliance that circulates heated air through the chamber. A controller is configured to receive a command to initiate an appliance travel cycle and implement a responsive action to prepare the dryer appliance for travel. The responsive action may be the automated adjustment of one or more operating parameters of the dryer appliance, such as performing a load sensing procedure, drying the chamber, closing the water supply valves, etc. In addition, the responsive action may include providing a user instruction to prepare the dryer appliance, e.g., by cleaning the lint filter, emptying the condensate collection tank, removing hoses and cables, addressing any error codes, etc.

20 Claims, 4 Drawing Sheets

(51) Int. Cl.

| | |
|---|---|
| ***D06F 34/18*** | (2020.01) |
| ***D06F 34/20*** | (2020.01) |
| ***D06F 34/28*** | (2020.01) |
| ***D06F 58/24*** | (2006.01) |
| ***D06F 103/04*** | (2020.01) |
| ***D06F 103/42*** | (2020.01) |
| ***D06F 103/58*** | (2020.01) |
| ***D06F 105/02*** | (2020.01) |
| ***D06F 105/54*** | (2020.01) |
| ***D06F 105/58*** | (2020.01) |

(52) U.S. Cl.
CPC ..... *D06F 34/28* (2020.02); *D06F 58/24* (2013.01); *D06F 2103/04* (2020.02); *D06F 2103/42* (2020.02); *D06F 2103/58* (2020.02); *D06F 2105/02* (2020.02); *D06F 2105/54* (2020.02); *D06F 2105/58* (2020.02)

(58) Field of Classification Search
CPC ..... D06F 2103/42; D06F 2103/04; D06F 2103/58; D06F 2105/58; D06F 2105/02
USPC ..... 34/427, 595–610
See application file for complete search history.

(56) References Cited

U.S. PATENT DOCUMENTS

| | | | | |
|---|---|---|---|---|
| 9,109,324 | B2 * | 8/2015 | Chatot | D06F 58/50 |
| 9,605,375 | B2 * | 3/2017 | Frank | D06F 58/44 |
| 9,890,494 | B2 | 2/2018 | Jang | |
| 2013/0239336 | A1 | 9/2013 | Cho | |
| 2017/0342646 | A1 * | 11/2017 | Qian | D06F 29/005 |
| 2021/0230792 | A1 * | 7/2021 | Graeser | D06F 58/26 |
| 2022/0298706 | A1 * | 9/2022 | Ekbundit | D06F 33/43 |
| 2022/0298718 | A1 * | 9/2022 | Ekbundit | D06F 58/32 |

* cited by examiner

TRAVEL CYCLE FOR A CONDENSER OR HEAT PUMP DRYER APPLIANCE

FIELD OF THE INVENTION

The present subject matter relates generally to dryer appliances, or more specifically, to systems and methods for preparing a heat pump or condenser dryer appliance for movement or travel.

BACKGROUND OF THE INVENTION

Laundry appliances are commonly installed in fixed locations, e.g., in a laundry room, where they are securely grounded during operation. These stable locations provide for safe operation of the appliances and their many moving parts. For example, dryer appliances are designed to absorb or handle moderate forces associated with the movement of such components during normal operation while the dryer appliance is stable and stationary. However, laundry appliances may periodically need to be moved or transported from one location to another. For example, these appliances may be transferred between properties when the consumer moves between homes. In mobile appliance installations, such as in recreational vehicles, movement or transport of these laundry appliances is particularly frequent.

Notably, such appliance transport may cause damage to the appliance, the transport vehicle, the installation area, and/or external objects if preventative measures are not taken. For example, moving internal components of the appliance may experience forces not associated with normal operation, resulting in the potential for excessive wear and premature failure of appliance components. In addition, fluids in the appliance can leak, doors may swing freely, and mold or mildew may form if the drum is not properly drained and dried prior to transport.

Accordingly, a laundry appliance with features for improved transport would be desirable. More specifically, a condenser dryer appliance with automated methods for working with a user to facilitate appliance movement with minimal wear or damage would be particularly beneficial.

BRIEF DESCRIPTION OF THE INVENTION

Advantages of the invention will be set forth in part in the following description, or may be apparent from the description, or may be learned through practice of the invention.

In one exemplary embodiment, a dryer appliance is provided including a cabinet, a drum rotatably mounted within the cabinet, the drum defining a chamber for receipt of articles for drying, the drum defining a drum exit and a drum inlet to the chamber, a conditioning system configured to heat and remove moisture from air flowing therethrough, a duct system for providing fluid communication between the drum exit and the conditioning system and between the conditioning system and the drum inlet, the duct system, the conditioning system, and the drum defining a process air flowpath, a blower fan operable to move air through the process air flowpath, and a controller configured to receive a command to initiate an appliance travel cycle and implement a responsive action to prepare the dryer appliance for travel.

In another exemplary embodiment, a method of operating a dryer appliance is provided. The dryer appliance includes a drum rotatably mounted within a cabinet, the drum defining a chamber for receipt of articles for drying, the drum defining a drum exit and a drum inlet to the chamber, a conditioning system configured to heat and remove moisture from air flowing therethrough, a duct system for providing fluid communication between the drum exit and the conditioning system and between the conditioning system and the drum inlet, the duct system, the conditioning system, and the drum defining a process air flowpath, and a blower fan operable to move air through the process air flowpath. The method includes receiving a command to initiate an appliance travel cycle and implementing a responsive action to prepare the dryer appliance for travel.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
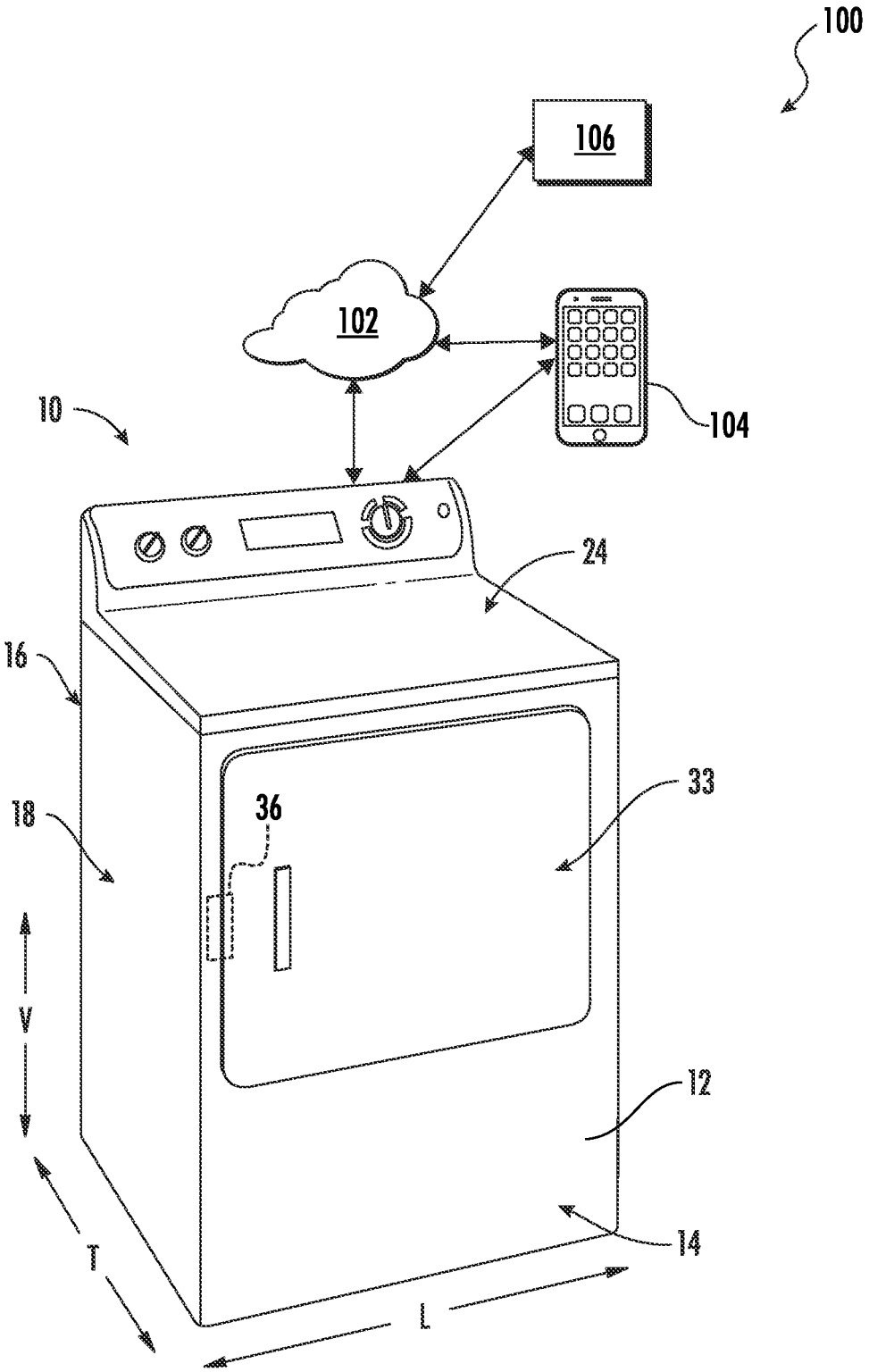
FIG. 1 provides a perspective view of a dryer appliance in accordance with exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). Approximating language, as used herein throughout the specification and claims, is applied to modify any quantitative representation that could permissibly vary without resulting in a change in the basic function to which it is related. Accordingly, a value modified by a term or terms, such as "about," "approximately," and "substantially," are not to be limited to the precise value specified. In at least some instances, the approximating language may correspond to the precision of an instrument for measuring the value. For example, the approximating language may refer to being within a 10 percent margin.

Figure 2:
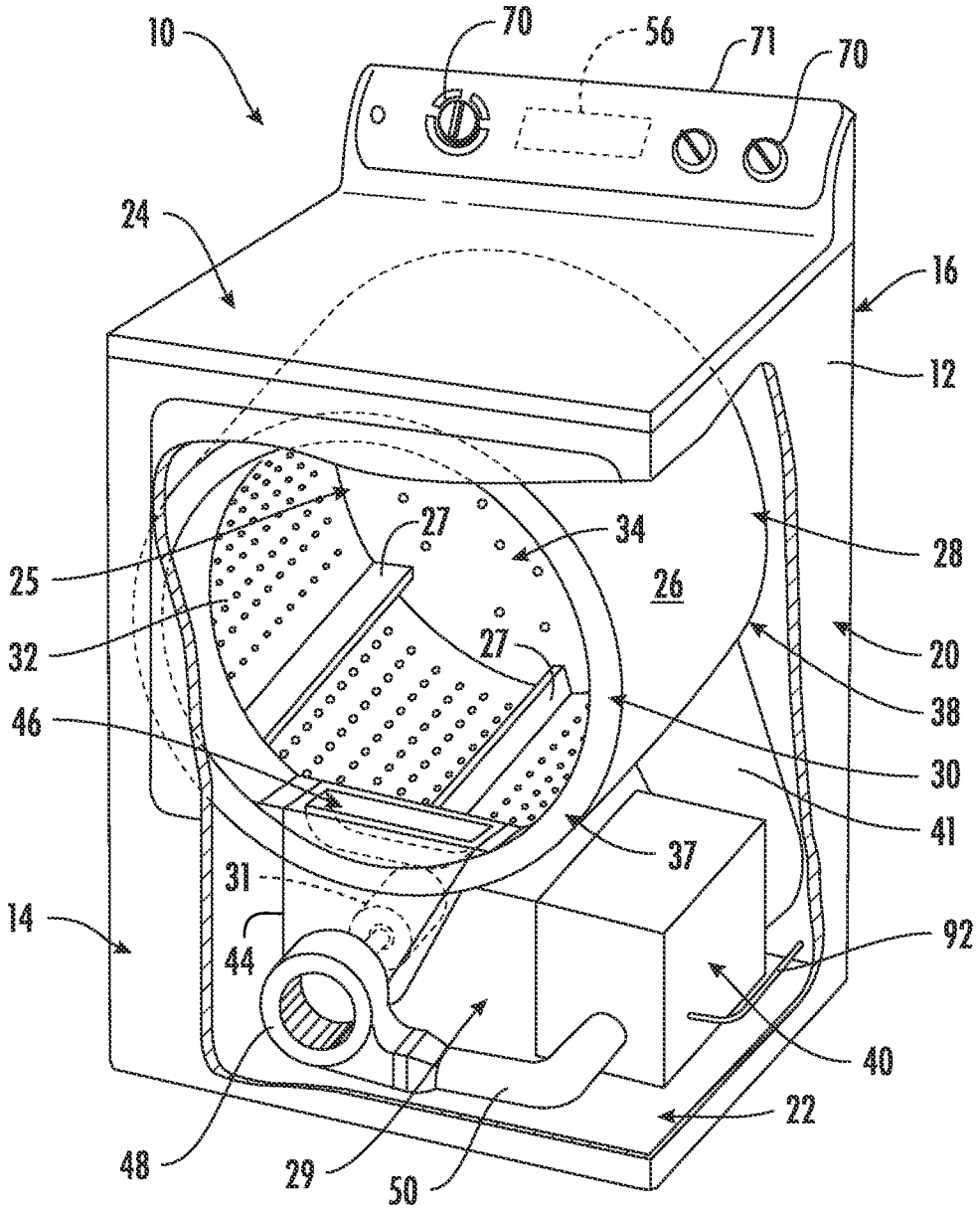
FIG. 2 provides a perspective view of the example dryer appliance of FIG. 1 with portions of a cabinet of the dryer appliance removed to reveal certain components of the dryer appliance.

Referring now to the figures, an exemplary laundry appliance that may be used to implement aspects of the present subject matter will be described. Specifically, FIGS. 1 and 2 provide perspective views of a dryer appliance 10 according to exemplary embodiments of the present disclosure. Particularly, FIG. 1 provides a perspective view of dryer appliance 10 and FIG. 2 provides another perspective view of dryer appliance 10 with a portion of a housing or cabinet 12 of dryer appliance 10 removed in order to show certain components of dryer appliance 10. As depicted, dryer appliance 10 defines a vertical direction V, a lateral direction L, and a transverse direction T, each of which is mutually perpendicular such that an orthogonal coordinate system is defined. While described in the context of a specific embodiment of dryer appliance 10, using the teachings disclosed herein it will be understood that dryer appliance 10 is provided by way of example only. Other dryer appliances having different appearances and different features may also be utilized with the present subject matter as well. For instance, in some embodiments, dryer appliance 10 can be a combination washing machine/dryer appliance.

Cabinet 12 includes a front panel 14, a rear panel 16, a pair of side panels 18 and 20 spaced apart from each other by front and rear panels 14 and 16 along the lateral direction L, a bottom panel 22, and a top cover 24. Cabinet 12 defines an interior volume 29. A drum or container 26 is mounted for rotation about a substantially horizontal axis within the interior volume 29 of cabinet 12. Drum 26 defines a chamber 25 for receipt of articles for tumbling and/or drying. Drum 26 extends between a front portion 37 and a back portion 38, e.g., along the transverse direction T. Drum 26 also includes a back or rear wall 34, e.g., at back portion 38 of drum 26. A supply duct 41 may be mounted to rear wall 34. Supply duct 41 receives heated air that has been heated by a conditioning system 40 and provides the heated air to drum 26 via one or more holes defined by rear wall 34.

As used herein, the terms "clothing" or "articles" includes but need not be limited to fabrics, textiles, garments, linens, papers, or other items from which the extraction of moisture is desirable. Furthermore, the term "load" or "laundry load" refers to the combination of clothing that may be washed together in a washing machine or dried together in a dryer appliance 10 (e.g., clothes dryer) and may include a mixture of different or similar articles of clothing of different or similar types and kinds of fabrics, textiles, garments and linens within a particular laundering process.

In some embodiments, a motor 31 is provided to rotate drum 26 about the horizontal axis, e.g., via a pulley and a belt (not pictured). Drum 26 is generally cylindrical in shape. Drum 26 has an outer cylindrical wall 28 and a front flange or wall 30 that defines an opening 32 of drum 26, e.g., at front portion 37 of drum 26, for loading and unloading of articles into and out of chamber 25 of drum 26. Drum 26 includes a plurality of lifters or baffles 27 that extend into chamber 25 to lift articles therein and then allow such articles to tumble back to a bottom of drum 26 as drum 26 rotates. Baffles 27 may be mounted to drum 26 such that baffles 27 rotate with drum 26 during operation of dryer appliance 10.

Rear wall 34 of drum 26 is rotatably supported within cabinet 12 by a suitable bearing. Rear wall 34 can be fixed or can be rotatable. Rear wall 34 may include, for instance, a plurality of holes that receive hot air that has been heated by a conditioning system 40, e.g., a heat pump or refrigerant-based conditioning system as will be described further below. Moisture laden, heated air is drawn from drum 26 by an air handler, such as a blower fan 48, which generates a negative air pressure within drum 26.

As shown, dryer appliance 10 may further include one or more lint filters 46 (FIG. 2) to collect lint during drying operations. The moisture laden heated air passes through a duct 44 enclosing screen filter 46, which traps lint particles. More specifically, filter 46 may be placed into the path 58 of air flow through appliance 10 and include a screen, mesh, other material to capture lint in the air flow. The location of lint filters in appliance 10 as shown in FIG. 2 is provided by way of example only, and other locations may be used as well. As shown, lint filter 46 is readily accessible by a user of the appliance. As such, lint filter 46 should be manually cleaned by removal of the filter, pulling or wiping away accumulated lint, and then replacing the filter 46 for subsequent drying cycles.

As the air passes from blower fan 48, it enters a duct 50 and then is passed into conditioning system 40. In some embodiments, the conditioning system 40 may be or include an electric heating element, e.g., a resistive heating element, or a gas-powered heating element, e.g., a gas burner. According to the illustrated exemplary embodiment, dryer appliance 10 is a heat pump dryer appliance and thus conditioning system 40 may be or include a heat pump including a sealed refrigerant circuit, as described in more detail below with reference to FIG. 3. Heated air (with a lower moisture content than was received from drum 26), exits conditioning system 40 and returns to drum 26 by duct 41. After the clothing articles have been dried, they are removed from the drum 26 via opening 32.

A door 33 provides for closing or accessing drum 26 through opening 32. According to exemplary embodiments, a window (not shown) in door 33 permits viewing of chamber 25 when door 33 is in the closed position, e.g., during operation of dryer appliance 10. Door 33 also includes a handle that, e.g., a user may pull when opening and closing door 33. Further, although door 33 is illustrated as mounted to front panel 14, it should be appreciated that door 33 may be mounted to another side of cabinet 12 or any other suitable support according to alternative embodiments. Dryer appliance 10 may further include a latch assembly 36 (see FIG. 1) that is mounted to cabinet 12 and/or door 33 for selectively locking door 33 in the closed position. Latch assembly 36 may be desirable, for example, to ensure only secured access to chamber 25 or to otherwise ensure and verify that door 33 is closed during certain operating cycles or events.

According to exemplary embodiments, dryer appliance 10 may facilitate a steam dry process. In this regard, dryer appliance 10 may offer a steam drying cycle, during which steam is injected into chamber 25, e.g., to function similar to a traditional garment steamer to help remove wrinkles, static, etc. Accordingly, as shown for example in FIG. 3, dryer appliance 10 may include a misting nozzle 62 that is in fluid communication with a water supply 64 in order to direct mist into chamber 25. Dryer appliance 10 may further include a water supply valve or control valve 66 for selecting discharging the flow of mist into chamber 25. It should be appreciated that control valve 66 may be positioned at any other suitable location within cabinet 12.

In some embodiments, one or more selector inputs 70, such as knobs, buttons, touchscreen interfaces, etc., may be provided or mounted on a cabinet 12 (e.g., on a user interface panel 71 mounted on a backsplash) and are communicatively coupled with (e.g., electrically coupled or coupled through a wireless network band) a processing device or controller 56. Controller 56 may also be communicatively coupled with various operational components of dryer appliance 10, such as motor 31, blower 48, and/or components of conditioning system 40. In turn, signals generated in controller 56 direct operation of motor 31, blower 48, or conditioning system 40 in response user inputs to selector inputs 70. As used herein, "processing device" or "controller" may refer to one or more microprocessors, microcontroller, ASICS, or semiconductor devices and is not restricted necessarily to a single element. The controller 56 may be programmed to operate dryer appliance 10 by executing instructions stored in memory (e.g., non-transitory media). The controller 56 may include, or be associated with, one or more memory elements such as RAM, ROM, or electrically erasable, programmable read only memory (EEPROM). For example, the instructions may be software or any set of instructions that when executed by the processing device, cause the processing device to perform operations. It should be noted that controller 56 as disclosed herein is capable of and may be operable to perform any methods or associated method steps as disclosed herein. For example, in some embodiments, methods disclosed herein may be embodied in programming instructions stored in the memory and executed by the controller 56.

Figure 3:
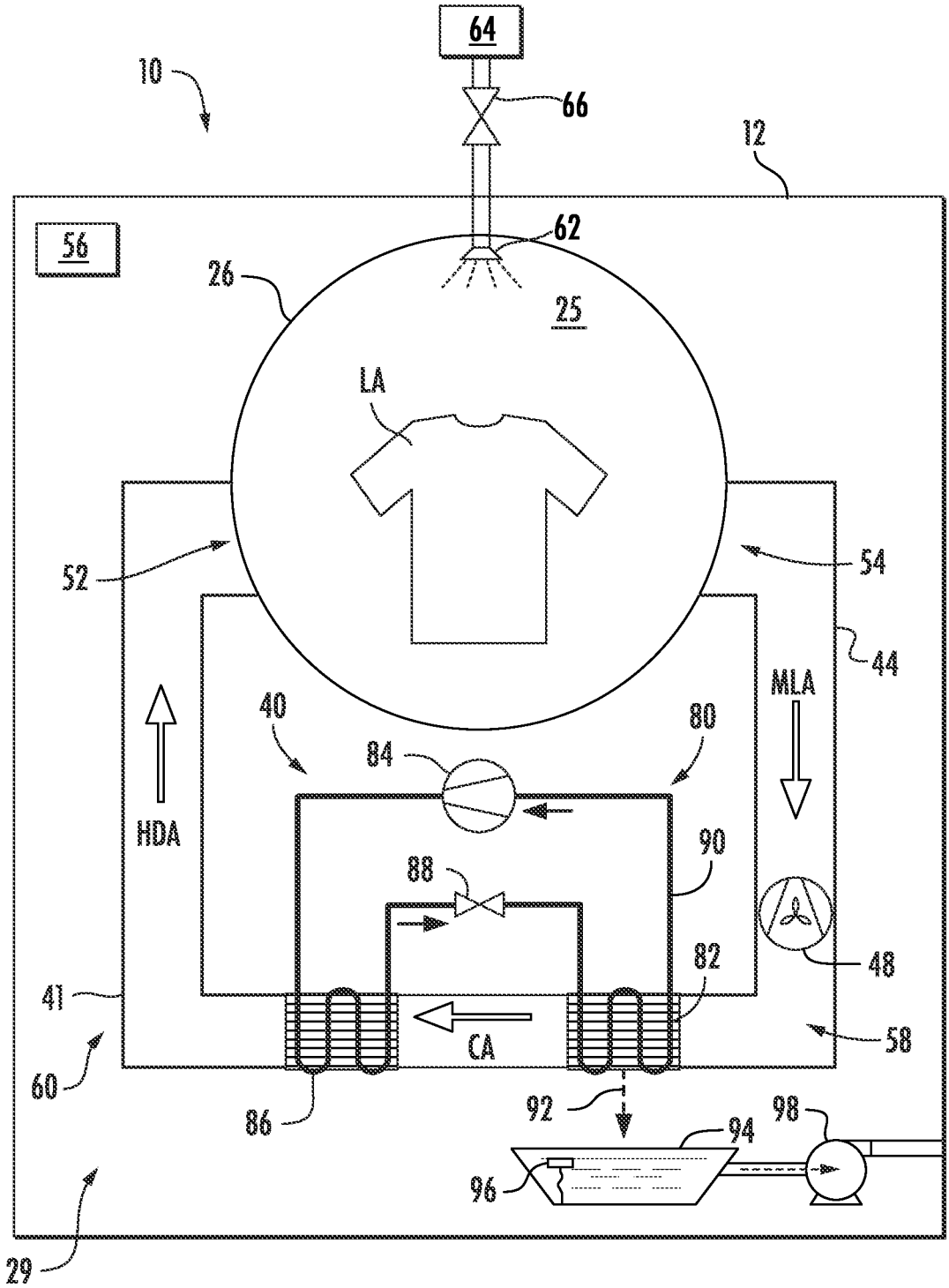
FIG. 3 provides a schematic diagram of an exemplary heat pump dryer appliance and a conditioning system thereof in accordance with exemplary embodiments of the present disclosure.

FIG. 3 provides a schematic view of dryer appliance 10 and depicts conditioning system 40 in more detail. For this embodiment, dryer appliance 10 is a heat pump dryer appliance and thus conditioning system 40 includes a sealed system 80. Sealed system 80 includes various operational components, which can be encased or located within a machinery compartment of dryer appliance 10. Generally, the operational components are operable to execute a vapor compression cycle for heating process air passing through conditioning system 40. The operational components of sealed system 80 include an evaporator 82, a compressor 84, a condenser 86, and one or more expansion devices 88 connected in series along a refrigerant circuit or line 90. Refrigerant line 90 is charged with a working fluid, which in this example is a refrigerant. Sealed system 80 depicted in FIG. 3 is provided by way of example only. Thus, it is within the scope of the present subject matter for other configurations of the sealed system to be used as well. As will be understood by those skilled in the art, sealed system 80 may include additional components, e.g., at least one additional evaporator, compressor, expansion device, and/or condenser. As an example, sealed system 80 may include two (2) evaporators.

In performing a drying and/or tumbling cycle, one or more laundry articles LA may be placed within the chamber 25 of drum 26. Hot dry air HDA is supplied to chamber 25 via duct 41. The hot dry air HDA enters chamber 25 of drum 26 via a drum inlet 52 defined by drum 26, e.g., the plurality of holes defined in rear wall 34 of drum 26 as shown in FIG. 2. The hot dry air HDA provided to chamber 25 causes moisture within laundry articles LA to evaporate. Accordingly, the air within chamber 25 increases in water content and exits chamber 25 as warm moisture laden air MLA. The warm moisture laden air MLA exits chamber 25 through a drum outlet 54 defined by drum 26 and flows into duct 44.

After exiting chamber 25 of drum 26, the warm moisture laden air MLA flows downstream to conditioning system 40. Blower fan 48 moves the warm moisture laden air MLA, as well as the air more generally, through a process air flowpath 58 defined by drum 26, conditioning system 40, and the duct system 60. Thus, generally, blower fan 48 is operable to move air through or along the process air flowpath 58. Duct system 60 includes all ducts that provide fluid communication (e.g., airflow communication) between drum outlet 54 and conditioning system 40 and between conditioning system 40 and drum inlet 52. Although blower fan 48 is shown positioned between drum 26 and conditioning system 40 along duct 44, it will be appreciated that blower fan 48 can be positioned in other suitable positions or locations along duct system 60.

As further depicted in FIG. 3, the warm moisture laden air MLA flows into or across evaporator 82 of the conditioning system 40. As the moisture-laden air MLA passes across evaporator 82, the temperature of the air is reduced through heat exchange with refrigerant that is vaporized within, for example, coils or tubing of evaporator 82. This vaporization process absorbs both the sensible and the latent heat from the moisture-laden air MLA—thereby reducing its temperature. As a result, moisture in the air is condensed and such condensate water may be drained from conditioning system 40, e.g., using a drain line 92, which is also depicted in FIG. 2.

For this embodiment, a condenser tank or a condensate collection tank 94 is in fluid communication with conditioning system 40, e.g., via drain line 92. Collection tank 94 is operable to receive condensate water from the process air flowing through conditioning system 40, and more particularly, condensate water from evaporator 82. A sensor 96 operable to detect when water within collection tank 94 has reached a predetermined level. Sensor 96 can be any suitable type of sensor, such as a float switch as shown in FIG. 3. Sensor 96 can be communicatively coupled with controller 56, e.g., via a suitable wired or wireless communication link. A drain pump 98 is in fluid communication with collection tank 94. Drain pump 98 is operable to remove a volume of water from collection tank 94 and, for example, discharge the collected condensate to an external drain. In some embodiments, drain pump 98 can remove a known or predetermined volume of water from collection tank 94. Drain pump 98 can remove the condensate water from collection tank 94 and can move or drain the condensate water downstream, e.g., to a gray water collection system. Particularly, in some embodiments, controller 56 is configured to receive, from sensor 96, an input indicating that water within the collection tank has reached the predetermined level. In response to the input indicating that water within collection tank 94 has reached the predetermined level, controller 56 can cause drain pump 98 to remove the predetermined volume of water from collection tank 94.

Air passing over evaporator 82 becomes cooler than when it exited drum 26 at drum outlet 54. As shown in FIG. 3, cool air CA (cool relative to hot dry air HDA and moisture laden air MLA) flowing downstream of evaporator 82 is subsequently caused to flow across condenser 86, e.g., across coils or tubing thereof, which condenses refrigerant therein. The refrigerant enters condenser 86 in a gaseous state at a relatively high temperature compared to the cool air CA from evaporator 82. As a result, heat energy is transferred to the cool air CA at the condenser 86, thereby elevating its temperature and providing warm dry air HDA for resupply to drum 26 of dryer appliance 10. The warm dry air HDA passes over and around laundry articles LA within the chamber 25 of the drum 26, such that warm moisture laden air MLA is generated, as mentioned above. Because the air is recycled through drum 26 and conditioning system 40, dryer appliance 10 can have a much greater efficiency than traditional clothes dryers can where all of the warm, moisture-laden air MLA is exhausted to the environment.

With respect to sealed system 80, compressor 84 pressurizes refrigerant (i.e., increases the pressure of the refrigerant) passing therethrough and generally motivates refrigerant through the sealed refrigerant circuit or refrigerant line 90 of conditioning system 40. Compressor 84 may be communicatively coupled with controller 56 (communication lines not shown in FIG. 3). Refrigerant is supplied from the evaporator 82 to compressor 84 in a low pressure gas phase. The pressurization of the refrigerant within compressor 84 increases the temperature of the refrigerant. The compressed refrigerant is fed from compressor 84 to condenser 86 through refrigerant line 90. As the relatively cool air CA from evaporator 82 flows across condenser 86, the refrigerant is cooled and its temperature is lowered as heat is transferred to the air for supply to chamber 25 of drum 26.

Upon exiting condenser 86, the refrigerant is fed through refrigerant line 90 to expansion device 88. Although only one expansion device 88 is shown, such is by way of example only. It is understood that multiple such devices may be used. In the illustrated example, expansion device 88 is an electronic expansion valve, although a thermal expansion valve or any other suitable expansion device can be used. In additional embodiments, any other suitable expansion device, such as a capillary tube, may be used as well. Expansion device 88 lowers the pressure of the refrigerant and controls the amount of refrigerant that is allowed to enter the evaporator 82. Importantly, the flow of liquid refrigerant into evaporator 82 is limited by expansion device 88 in order to keep the pressure low and allow expansion of the refrigerant back into the gas phase in evaporator 82. The evaporation of the refrigerant in evaporator 82 converts the refrigerant from its liquid-dominated phase to a gas phase while cooling and drying the moisture laden air MLA received from chamber 25 of drum 26. The process is repeated as air is circulated along process air flowpath 58 while the refrigerant is cycled through sealed system 80, as described above.

Although dryer appliance 10 is depicted and described herein as a heat pump dryer appliance, the inventive aspects of the present disclosure can apply to other types of closed loop airflow circuit dryer appliances. For instance, in other embodiments, dryer appliance 10 can be a condenser dryer that utilizes an air-to-air heat exchanger instead of evaporator 82 and/or an electric heater may be provided instead of condenser 86. Thus, in such embodiments, the working fluid that interacts thermally with the process air may be air. In yet other embodiments, dryer appliance 10 can be a spray tower dryer appliance that utilizes a water-to-air heat exchanger instead of utilizing a sealed refrigerant. Thus, in such embodiments, the working fluid that interacts thermally with the process air may be water. Further, in some embodiments, dryer appliance 10 can be a combination washer/dryer appliance having a closed loop airflow circuit along which process air may flow for drying operations.

Referring again to FIG. 1, a schematic diagram of an external communication system 100 will be described according to an exemplary embodiment of the present subject matter. In general, external communication system 100 is configured for permitting interaction, data transfer, and other communications with dryer appliance 10. For example, this communication may be used to provide and receive operating parameters, user instructions or notifications, performance characteristics, user preferences, or any other suitable information for improved performance of dryer appliance 10.

External communication system 100 permits controller 56 of dryer appliance 10 to communicate with external devices either directly or through a network 102. For example, a consumer may use a consumer device 104 to communicate directly with dryer appliance 10. For example, consumer devices 104 may be in direct or indirect communication with dryer appliance 10, e.g., directly through a local area network (LAN), Wi-Fi, Bluetooth, Zigbee, etc. or indirectly through network 102. In general, consumer device 104 may be any suitable device for providing and/or receiving communications or commands from a user. In this regard, consumer device 104 may include, for example, a personal phone, a tablet, a laptop computer, or another mobile device.

In addition, a remote server 106 may be in communication with dryer appliance 10 and/or consumer device 104 through network 102. In this regard, for example, remote server 106 may be a cloud-based server 106, and is thus located at a distant location, such as in a separate state, country, etc. In general, communication between the remote server 106 and the client devices may be carried via a network interface using any type of wireless connection, using a variety of communication protocols (e.g. TCP/IP, HTTP, SMTP, FTP), encodings or formats (e.g. HTML, XML), and/or protection schemes (e.g. VPN, secure HTTP, SSL).

In general, network 102 can be any type of communication network. For example, network 102 can include one or more of a wireless network, a wired network, a personal area network, a local area network, a wide area network, the internet, a cellular network, etc. According to an exemplary embodiment, consumer device 104 may communicate with a remote server 106 over network 102, such as the internet, to provide user inputs, receive user notifications or instructions, etc. In addition, consumer device 104 and remote server 106 may communicate with dryer appliance 10 to communicate similar information.

External communication system 100 is described herein according to an exemplary embodiment of the present subject matter. However, it should be appreciated that the exemplary functions and configurations of external communication system 100 provided herein are used only as examples to facilitate description of aspects of the present subject matter. System configurations may vary, other communication devices may be used to communicate directly or indirectly with one or more laundry appliances, other communication protocols and steps may be implemented, etc. These variations and modifications are contemplated as within the scope of the present subject matter.

Now that the construction of dryer appliance 10 and the configuration of controller 56 according to exemplary embodiments have been presented, an exemplary method 200 of operating a dryer appliance will be described. Although the discussion below refers to the exemplary method 200 of operating dryer appliance 10, one skilled in the art will appreciate that the exemplary method 200 is applicable to the operation of a variety of other dryer appliances or laundry appliances. In exemplary embodiments, the various method steps as disclosed herein may be performed by controller 56 or a separate, dedicated controller.

As explained briefly above, laundry appliances such as dryer appliance 10, may periodically be moved from one location to another. These movements may cause damage to the appliance removal location, the appliance installation location, the vehicle for transporting the appliance, and/or the appliance itself. For example, failure to properly prepare dryer appliance 10 for movement may result in the appliance door swinging open and striking objects, fluids spilling from their reservoirs, undrained water leaking from the appliance, internal components making undesirable and damaging contact with each other, and/or the undesirable formation of mold, mildew, or other foul smells. Accordingly, aspects of the present subject matter are directed toward systems and methods for properly preparing an appliance prior to movement in a manner that mitigates some or all of the negative events described above.

Figure 4:
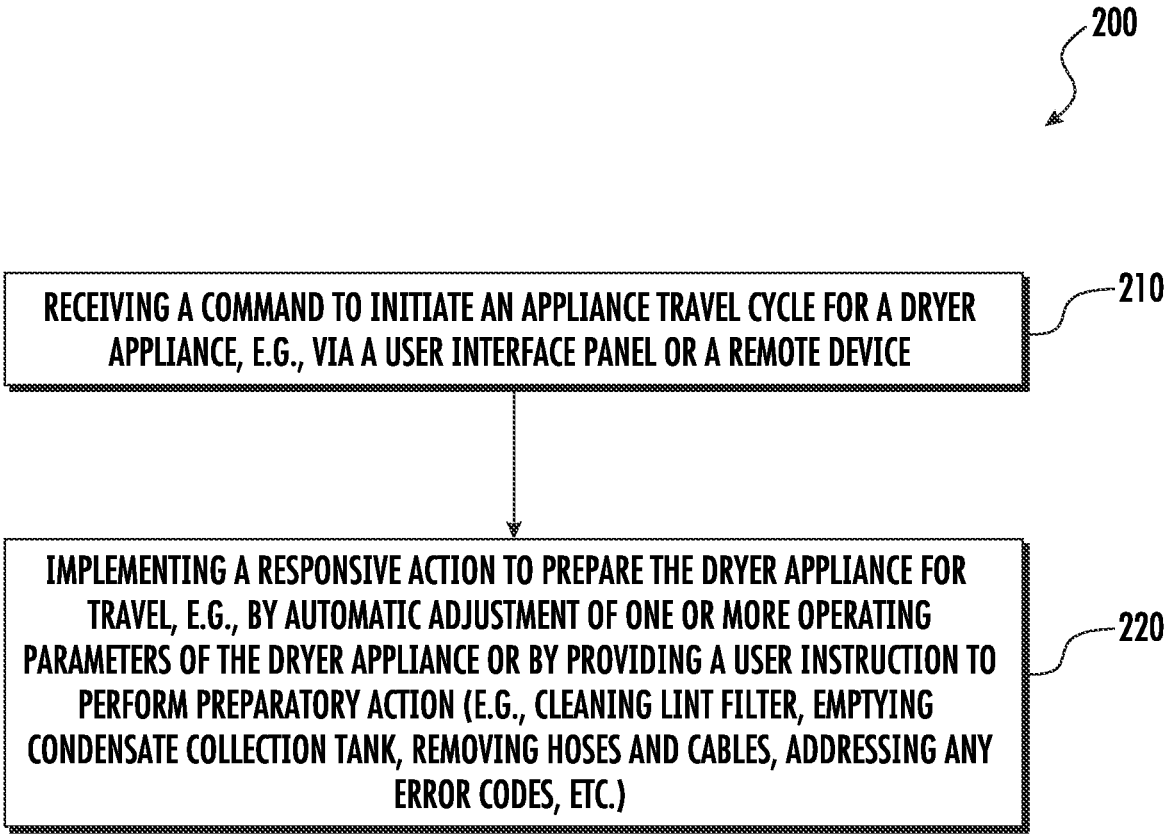
FIG. 4 illustrates a method for operating a condenser dryer appliance in accordance with one embodiment of the present disclosure.

Referring now to FIG. 4, method 200 includes, at step 210, receiving a command to initiate an appliance travel cycle. For example, continuing the example from above, dryer appliance 10 may receive a command, e.g., from a user of the appliance, to initiate the appliance travel cycle. It should be appreciated that the command to initiate the appliance travel cycle may be received from any suitable source and in any suitable manner. According to exemplary embodiments, a user may enter the command using a user interface panel, such as user interface panel 71 of dryer appliance 10. In this regard, for example, one of input selectors 70 may be a button, a switch, a rotary dial, a capacitive touch button, a touchscreen, or another mechanical or tactile input that a user may select to initiate the appliance travel cycle. According to still other embodiments, a user may initiate the appliance travel cycle remotely, e.g., using a consumer device 104 such as a cell phone. In this regard, a user may enter a mobile software application on their phone and may enter a command to enter the appliance travel cycle prior to moving dryer appliance 10. Other manners of receiving the appliance travel cycle command are possible and within the scope of the present subject matter.

Method 200 may further include, at step 220, implementing a responsive action to prepare the dryer appliance for travel. As used herein, the terms "responsive action" and the like are generally intended to refer to any adjustments or manipulations of dryer appliance 10 made by dryer appliance 10 (e.g., as regulated by controller 56), by a user, or by any other interacting force that are intended to prepare the appliance for subsequent movement. Although exemplary responsive actions are described herein, it should be appreciated that these responsive actions are only intended to facilitate discussion of the present subject matter and are not intended to be limiting in any manner. Other responsive actions are possible and within the scope of the present subject matter.

According to exemplary embodiments of the present subject matter, it may be desirable to ensure that chamber 25 is empty of all clothing or other items prior to transport. Therefore, according to an exemplary embodiment, implementing the responsive action may include performing a load sensing procedure or algorithm to verify that chamber 25 is empty. Any suitable load sensing or size detection algorithm may be implemented, such as commonly performed by washer appliance prior to a wash cycle or prior to a dry cycle.

As used herein, the terms "load sensing" and the like are generally intended to refer to any process for obtaining a weight of the load of clothes in a dryer appliance or for detecting the presence of any items within the chamber. For example, according to an exemplary embodiment, the load sensing procedure may include rotating the drum at a predetermined spin speed and monitoring a force, torque, or inertia generated by or at the motor assembly used to rotate the drum at that predetermined spin speed. Controller 56 may use this information as well as other information to estimate or calculate the load weight or identify the presence of items in the chamber, e.g., using regression equations, data correlation tables, other suitable algorithms or computations, etc.

According to exemplary embodiments, load sensing may include monitoring drum speed (e.g., in revolutions per minute) and the motor power (e.g., in Watts) over time. In this regard, for example, dryer appliance 10 may further include drum speed sensor (not shown), which may be any suitable sensor or sensors for monitoring the movement of chamber 25 and determining a measured drum speed of drum 26. For example, according to the exemplary embodiments, the drum speed sensor is a Hall Effect sensor, an accelerometer, or an optical sensor. Using the drum speed sensor, the load sensing procedure generally includes a sequence of spin operations and corresponding measurements of the drum speed and motor power. This method may further include maintaining the drum speed at this predetermined speed while monitoring motor torque, power, back electromotive force (EMF), etc.

If the load sensing procedure results in a determination that chamber 25 is empty, the appliance travel cycle may continue with one or more steps as described below. By contrast, if the load sensing procedure identifies the presence of one or more items in chamber 25, method 200 may include pausing the appliance travel cycle and/or providing a user notification or instruction to empty chamber 25. This user notification may be provided through user interface panel 71, via remote device 104, or in any other suitable manner.

Notably, it may also be desirable to ensure that chamber 25 is dry and/or that dryer appliance 10 does not contain any water or wash fluid that might leak out during transport, as such fluid may result in water damage or hazardous transportation conditions. Therefore, according to exemplary embodiments, step 220 of implementing a responsive action may include performing a drying cycle when the chamber is empty. Notably, this drying cycle may serve to ensure all residual water and moisture is evacuated from chamber, thereby reducing the likelihood of forming mold, mildew, or other foul smells. The responsive action may further include performing a timed drain cycle (e.g., using drain pump 98) to empty all water from condensate collection tank 94. In this manner, most or all of water within dryer appliance 10 may be discharged to an external drain or otherwise removed from the appliance.

Notably, prior to transport, it may also be desirable that all water supply valves are closed and all water supply hoses and/or electrical cables are disconnected in order to prevent leaks or electrical hazards. Thus, implementing the responsive action may further include closing one or more water supply valves or confirming that all water supply valves are closed. For example, normally open valves (e.g., valves that are open by default and require power to close) may be manually closed and normally closed valves (e.g., valves that are normally closed and require power to open) may be closed by removing power. Other steps for confirming that the water supply valves are closed are possible and within the scope of the present subject matter. In this regard, for example, upon receiving the command to initiate the appliance travel cycle, controller 56 may close water supply valve or control valve 66 (e.g., by removing power) and confirm the valve is closed to prevent further supply of water into chamber 25. In addition, the user may be instructed to remove or disconnect all water supply hoses, e.g., so that the appliance may be freely moved between locations. According to still other embodiments, the user may be instructed to remove, secure, or otherwise store all electrical cables.

After the chamber 25 is thoroughly dried, it may be desirable to lock door 33 in the closed position. In this regard, for example, the responsive action may be locking door 33 (e.g., using latch assembly 36) and verifying that door 33 is in a closed, locked state. In this manner, a user will be prevented from adding additional clothing items or objects into chamber 25 while dryer appliance 10 is in the appliance travel cycle. In addition, door 33 cannot be opened while dryer appliance 10 is being moved, thereby preventing door 33 from swinging freely and impacting objects, resulting in damage to external objects or the appliance itself.

Notably, according to exemplary embodiments, implementing the responsive action may further include communicating with a user of the appliance, e.g., via user interface panel 71 or a remote device 104, regarding steps that need to be performed to facilitate the appliance travel cycle. For example, according to exemplary embodiments, implementing the responsive action may include alerting a user of any service codes, error faults, or other issues that must be addressed with dryer appliance 10 prior to transport or prior to standard operation at the new location.

Method 200 may further include providing a user instruction to take preparatory action for facilitating the appliance travel cycle. For example, the user instruction may include a notification that water may be present within the condensate collection tank. As a result, the preparatory action may include emptying the condensate collection tank of all water or otherwise plugging the tank to prevent leaks during transport. Notably, this tank emptying process may be performed by a user of the appliance or may be an automated procedure implemented by an appliance controller. In addition, the preparatory action may include cleaning a lint filter (e.g., lint filter 46), cleaning the condenser coils or other components of sealed system 80 (e.g., by vacuuming the coils), or performing other mechanical intervention with any components of dryer appliance 10, e.g., to secure such components for transport. As noted above, the preparatory action may further include disconnecting and storing all water supply hoses, shutting off any manual valves, removing or securing electrical cables, or taking any other preventative action to prevent water leaks or electrical hazards during appliance transport. After all preparatory steps and responsive actions have been implemented, method 200 may include powering down the dryer appliance prior to movement of dryer appliance 10. In addition, method 200 may include powering down all lights, lamps, etc.

Notably, the user instructions for preparatory action may be received by the user in any suitable manner. According to exemplary embodiments, a user interface panel, such as user interface panel 71 may provide the user notification and may provide instructions regarding the preparatory action and necessary steps for facilitating appliance transport. According to still other embodiments, these user instructions or notices may be provided through a remote consumer device 104, such as a mobile phone. According to exemplary embodiments, once the appliance travel cycle has been performed, dryer appliance 10 may be moved with minimal risk of fluid leaks, damage to the appliance, or damage to external objects. According to exemplary embodiments, method 200 may include receiving a command to terminate the appliance travel cycle. For example, the appliance travel cycle may be terminated after the dryer appliance 10 has been moved and installed in a new location. Method 200 may include instructions or notifications regarding processes for reinstalling and confirming proper installation of the dryer appliance 10. Method 200 may further include returning all operating parameters of the dryer appliance 10 to a normal mode, e.g., a standard operating mode not associated with the appliance travel cycle.

FIG. 4 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 200 are explained using dryer appliance 10 as an example, it should be appreciated that these methods may be applied to the operation of any suitable dryer appliance or laundry appliance.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A dryer appliance comprising:

a cabinet;

a drum rotatably mounted within the cabinet, the drum defining a chamber for receipt of articles for drying, the drum defining a drum exit and a drum inlet to the chamber;

a conditioning system configured to heat and remove moisture from air flowing therethrough;

a duct system for providing fluid communication between the drum exit and the conditioning system and between the conditioning system and the drum inlet, the duct system, the conditioning system, and the drum defining a process air flowpath;

a blower fan operable to move air through the process air flowpath; and a controller configured to:

receive a command to initiate an appliance travel cycle; and implement a responsive action to prepare the dryer appliance for travel.

2. The dryer appliance of claim 1, wherein implementing the responsive action comprises:

performing a load sensing algorithm to verify that the chamber is empty.

3. The dryer appliance of claim 1, wherein implementing the responsive action comprises:

performing a drying cycle when the chamber is empty.

4. The dryer appliance of claim 1, wherein implementing the responsive action comprises:

verifying that a lint filter and a condensate collection tank are installed.

5. The dryer appliance of claim 1, further comprising:

one or more water supply valves, and wherein implementing the responsive action comprises closing the one or more water supply valves.

6. The dryer appliance of claim 1, further comprising:

a door pivotally mounted to the cabinet for providing selective access to a chamber; and a door lock for selectively locking the door in a closed position, wherein implementing the responsive action comprises verifying the door is closed and locked.

7. The dryer appliance of claim 1, wherein implementing the responsive action comprises:

alerting a user of any service codes or error faults.

8. The dryer appliance of claim 1, wherein implementing the responsive action comprises:

providing a user instruction to take a preparatory action for travel.

9. The dryer appliance of claim 8, further comprising:

a collection tank in fluid communication with the conditioning system for receiving condensate water from process air flowing through the conditioning system, wherein the preparatory action comprises emptying the collection tank.

10. The dryer appliance of claim 8, wherein the preparatory action comprises cleaning a lint filter or vacuuming components of the conditioning system.

11. The dryer appliance of claim 8, wherein the preparatory action comprises disconnecting all water supply hoses and electrical cables.

12. The dryer appliance of claim 8, further comprising:

a user interface panel positioned on the cabinet for facilitating user interaction with the dryer appliance, wherein the user instruction is provided through the user interface panel.

13. The dryer appliance of claim 12, wherein the command to initiate the appliance travel cycle is received from a user through the user interface panel.

14. The dryer appliance of claim 8, wherein the controller is in operative communication with a remote device through an external network, and wherein the user instruction is provided through the remote device.

15. The dryer appliance of claim 1, wherein the controller is further configured to:

determine that the responsive action has been implemented; and power down the dryer appliance.

16. The dryer appliance of claim 1, wherein the controller is further configured to:

receive a command to terminate the appliance travel cycle; and return all operating parameters of the dryer appliance to a normal mode.

17. A method of operating a dryer appliance, the dryer appliance comprising a drum rotatably mounted within a cabinet, the drum defining a chamber for receipt of articles for drying, the drum defining a drum exit and a drum inlet to the chamber, a conditioning system configured to heat and remove moisture from air flowing therethrough, a duct system for providing fluid communication between the drum exit and the conditioning system and between the conditioning system and the drum inlet, the duct system, the conditioning system, and the drum defining a process air flowpath, and a blower fan operable to move air through the process air flowpath, the method comprising:

receiving a command to initiate an appliance travel cycle; and implementing a responsive action to prepare the dryer appliance for travel.

18. The method of claim 17, wherein implementing the responsive action comprises at least one of performing a load sensing algorithm to verify that the chamber is empty or performing a drying cycle when the chamber is empty.

19. The method of claim 17, wherein implementing the responsive action comprises at least one of closing one or more water supply valves or verifying a door is closed and locked.

20. The method of claim 17, wherein implementing the responsive action comprises at least one of alerting a user of any service codes or error faults or providing a user instruction to take a preparatory action for travel.

* * * * *